US009611531B1

(12) United States Patent
Crawmer

(10) Patent No.: US 9,611,531 B1
(45) Date of Patent: Apr. 4, 2017

(54) TEXTURED SPRAY COATINGS FOR DECORATIVE AND FUNCTIONAL SURFACES AND METHOD OF APPLYING SAME

(71) Applicant: Thermal Spray Technologies, Inc., Sun Prairie, WI (US)

(72) Inventor: Daryl Crawmer, Fall River, WI (US)

(73) Assignee: Thermal Spray Technologies, Inc., Sun Prairie, WI (US)

( * ) Notice: Subject to any disclaimer, the term of this patent is extended or adjusted under 35 U.S.C. 154(b) by 0 days.

(21) Appl. No.: 14/560,996

(22) Filed: Dec. 4, 2014

Related U.S. Application Data

(60) Provisional application No. 61/911,801, filed on Dec. 4, 2013.

(51) Int. Cl.

| | |
|---|---|
| ***B24B 39/00*** | (2006.01) |
| ***C23C 4/08*** | (2016.01) |
| ***C23C 24/04*** | (2006.01) |
| ***C23C 4/12*** | (2016.01) |

(52) U.S. Cl.
CPC ..... *C23C 4/08* (2013.01); *C23C 4/12* (2013.01); *C23C 4/125* (2013.01); *C23C 24/04* (2013.01)

(58) Field of Classification Search
None
See application file for complete search history.

(56) References Cited

U.S. PATENT DOCUMENTS

2009/0314758 A1* 12/2009 Ganesh ..... B23K 9/04 219/137 R
2012/0266426 A1* 10/2012 Feldmann ..... B24B 31/003 29/90.01

FOREIGN PATENT DOCUMENTS

CA WO2013159216 * 10/2013
WO 2013/159216 10/2013

OTHER PUBLICATIONS

Saint-Gobain—Coating Solultions, Thermal Spray Procedure Flame Spraying, retrieved from the Internet on Nov. 5, 2014, http://www.coatingsolutions.saint-gobain.com/uploadedfiles/sgcoatingsolutions/documents/flexicord/flexicord-te-flexicord-tsp-procedure-en120723.pdf, 17 pages.

* cited by examiner

*Primary Examiner* — Nathan T Leong
(74) *Attorney, Agent, or Firm* — Michael Best & Friedrich LLP

(57) ABSTRACT

A method of coating and finishing an article includes applying a coating to the article using a spray-coating technique such that the applied coating has an as-sprayed surface porosity, and reducing the as-sprayed surface porosity of the coating to a finished surface porosity using a vibratory finishing process.

20 Claims, 2 Drawing Sheets

TEXTURED SPRAY COATINGS FOR DECORATIVE AND FUNCTIONAL SURFACES AND METHOD OF APPLYING SAME

RELATED APPLICATIONS

This application claims the benefit of U.S. Provisional Patent Application No. 61/911,801 filed Dec. 4, 2013, the entire content of which is incorporated by reference herein.

BACKGROUND

The present invention relates to coated articles and methods for applying and finishing coatings to achieve desired characteristics.

Sprayed-on coatings, such as thermal spray coatings, are commonly used to coat articles or parts to achieve desired wear, corrosion-resistance, and aesthetic characteristics. The sprayed-on coatings have appealing textural qualities. As-sprayed thermal spray coatings often have significant surface porosity, and it has been known to subsequently coat the thermal spray coatings with a sealant to seal off the pores and prevent intrusion of contaminants into the coating.

SUMMARY

The invention is directed to decorative and aesthetic sprayed-on coatings, especially suited for parts and surfaces exposed to bacterial contamination. Examples include parts such as handles, handholds, faucets, and accessories for residential, industrial, and commercial applications. Bath fixtures, kitchen fixtures and appliances, as well as components used in medical facilities are candidates for use with the inventive process. Coatings containing copper and copper-based alloys, which have known advantages for killing or stopping the spread of bacteria, are well-suited for use with this process, and can be beneficial with food-processing and handling implements, appliances, and devices and medical field apparatus such as handholds, trays, and other surfaces subject to bacterial contamination. Instead of using sealants, a mechanical process, such as vibratory finishing or vibratory polishing, is used to reduce the surface porosity. The finished coatings are highly stain resistant and aesthetically pleasing.

In one embodiment, the invention provides a method of coating and finishing an article. The method includes applying a coating to the article using a spray-coating technique such that the applied coating has an as-sprayed surface porosity, and reducing the as-sprayed surface porosity of the coating to a finished surface porosity using a vibratory finishing process.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
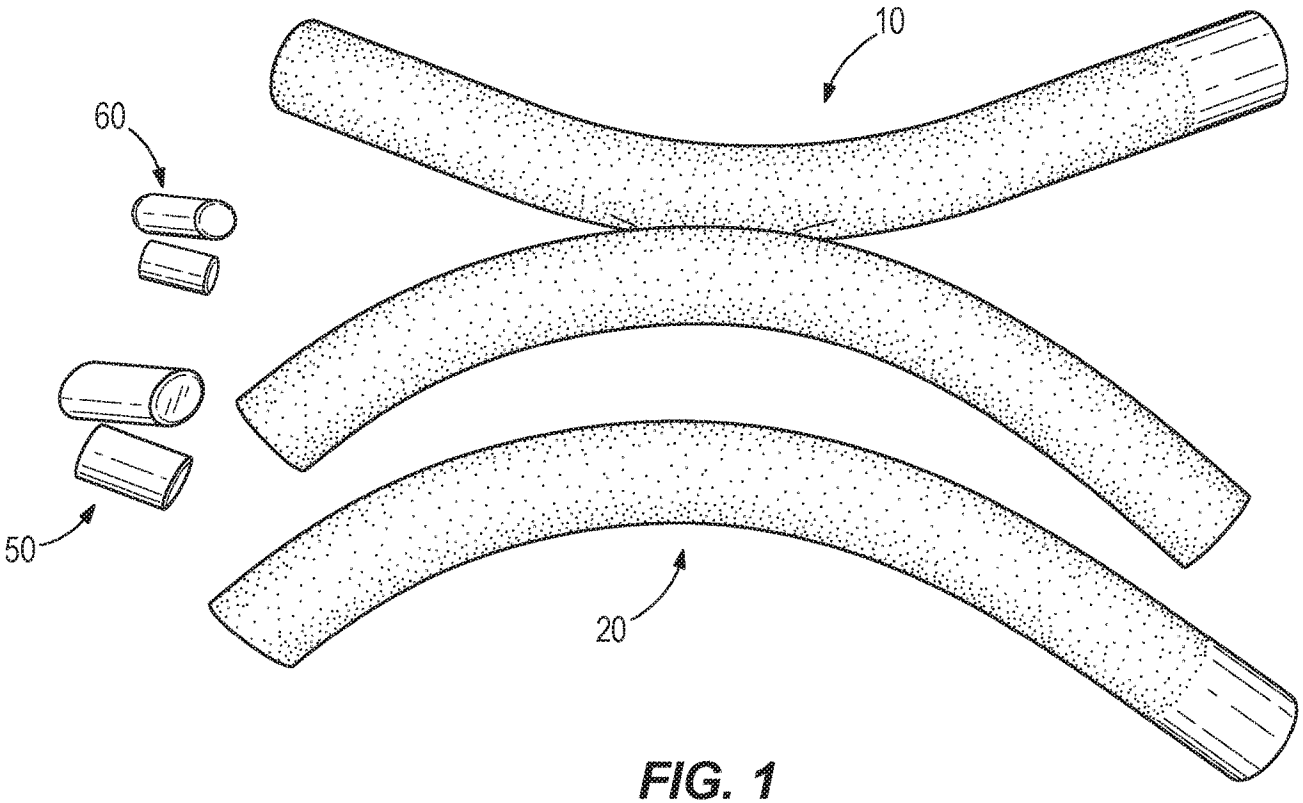
FIG. 1 is an image showing two sample articles made using the process of the invention, as well as exemplary vibratory media.

FIG. 1 illustrates two examples of articles or parts 10, 20 having finished coatings according to the present invention. The illustrated articles 10, 20 are tubular articles, but could take any of the various forms (or other forms) of the articles, parts, and components described above. The illustrated articles 10, 20 are made from low carbon steel, however, other materials can also be used. The surface preparation and coating compositions can be selected to suit the particular material defining the substrate or article.

The article 10 is shown as having two pieces joined together to produce a negative relief angle between the two joined pieces, thereby demonstrating the effectiveness of the spray coating and finishing processes on articles with such a complex geometry. The article 20 is a single piece of tubing, which could represent a portion of a handle, handrail, handhold, or faucet.

Prior to application of the coating, the articles 10, 20 were prepared to receive the coating. Specifically, the steel substrate/articles 10, 20 were first chemically cleaned to remove organic contamination, such as machine oil, fingerprints, and the like. After cleaning, grit blasting was performed to increase the surface area for enhanced adhesion of the coating. The grit blasting can be performed using aluminum oxide and compressed air. After cleaning and grit blasting, the articles 10, 20 are handled with gloves or in an automated manner to prevent contamination. As mentioned above, the specific preparation techniques can vary depending upon the material used for the articles and upon the specific coating to be applied.

The articles are then fixtured or supported using any suitable fixturing devices (e.g., clamps, vices, etc.). Once held in the desired orientation, the spray coating can be applied. The particular coating method and parameters, as well as the particular coating composition, can be selected as desired to achieve the desired as-sprayed coating characteristics (e.g., color, effect, texture, and function). Cold spray techniques or thermal spray techniques can be utilized. The illustrated articles 10, 20 were coated using a thermal spray coating technique. Thermal spray coatings are deposited by heating feedstock material to its melting point. As the material is heated to its melting point it is atomized and accelerated through a shaped nozzle toward a prepared substrate by process gasses or secondary jets of air or inert gas. Feedstock is typically in powder, wire, or rod form.

Specifically, a Thermach AT-400 electric arc spray (EAS) system was used for spraying. Operational parameters for the EAS system were 80 psi atomization air, 150 Adc, and 28-30 Vdc. The baseline parameters for stand-of, surface speed, and increment were set at 7 in., 20 in./sec, and 0.2 in., respectively. Again, other techniques and parameters can be substituted without deviating from the scope of the invention. Article 10 was coated with a 60/40 brass coating (e.g., C260 Brass), while article 20 was coated with a copper coating (e.g., C102 Copper). Other alloy coatings have also been tested, including C610 Aluminum Bronze, C752 Nickel Silver, and C656 Silicon Bronze. The desired color is one important aspect in selecting the appropriate coating for the particular application. Furthermore, coatings containing copper (e.g., at least 60% copper) are known for their anti-bacterial properties, and may be selected for applications in the health and medical fields, or for applications in which repeated human contact will occur.

Figure 2:
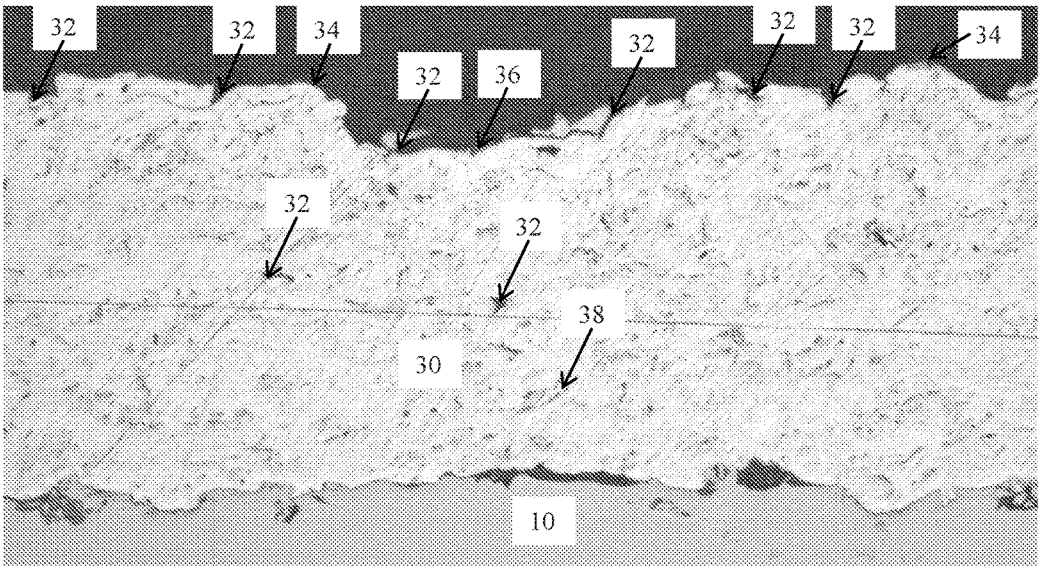
FIG. 2 is an optical photo micrograph of an as-sprayed coated article.

The as-sprayed coatings have characteristics associated with sprayed-on coatings. For example, as-sprayed coatings will typically exhibit as-sprayed surface roughness, as-sprayed surface porosity, and will have an as-sprayed microstructure. FIG. 2 illustrates the microstructure of the as-sprayed brass coating applied to article 10. The article or substrate is generally indicated as 10, while the coating is indicated as 30. Evident is the as-sprayed surface porosity, as represented by the numerous pores 32 along the surface. The microstructure below the surface also contains pores 32. The as-sprayed surface roughness is also evident based on the peaks 34 and valleys 36 seen along the surface. Oxide stringers, indicated generally as 38, are also seen in FIG. 1.

Previously, to prevent intrusion by debris, contaminants, and bacteria into the surface pores, liquid sealants were applied over the as-sprayed coating to seal the surface pores. Without such sealants, staining of the as-sprayed coating surface would occur. Furthermore, bacteria might find its way into the surface pores, making it difficult to disinfect the article. However, the sealants could, in some cases, alter the color, texture, and overall desired appearance of the as-sprayed coating.

According to the present invention, sealants are not applied over the as-sprayed coating. Furthermore, the coating need not be fused using a secondary fusing process. Instead, a mechanical surface finishing process, and more specifically, vibratory finishing (sometimes also referred to as vibratory polishing) is performed on the as-sprayed coated articles 10, 20. Vibratory finishing has conventionally been used to de-burr machined parts, or sometimes to add texturing to parts originally having a smooth finish. However, the use of vibratory finishing as an after-treatment for as-sprayed coatings has not heretofore been known. Vibratory finishing is a process in which an article is placed a container (often referred to as a bowl) with vibratory media. The container is moved to cause the vibratory media within the container to repeatedly impact the article.

After the articles 10, 20 have been sprayed, they undergo a vibratory finishing process, not for de-burring or adding texture, but instead for at least one of reducing the as-sprayed surface porosity, reducing the as-sprayed surface roughness, and refining the microstructure of the as-sprayed coating.

The articles 10, 20 were subject to their respective vibratory finishing processes as available from Midwest Finishing Systems, Inc., of Hartland, Wis. Specifically, the article 10 was placed in a three cubic foot bowl along with 0.5 inch×0.875 inch ACC vibratory media 50 (see FIG. 1). The vibratory media 50 was a twenty degree, thirty bond media 50 available from Midwest Finishing Systems, Inc. under the compound number MFS-232L. Other media can be substituted as desired. The article 10 and the media 50 were moved/vibrated in the bowl for approximately 3 hours. Those of skill in the art will understand that the specific bowl size, media, and duration of finishing can be varied as desired to achieve the desired finished characteristics.

Figure 3:
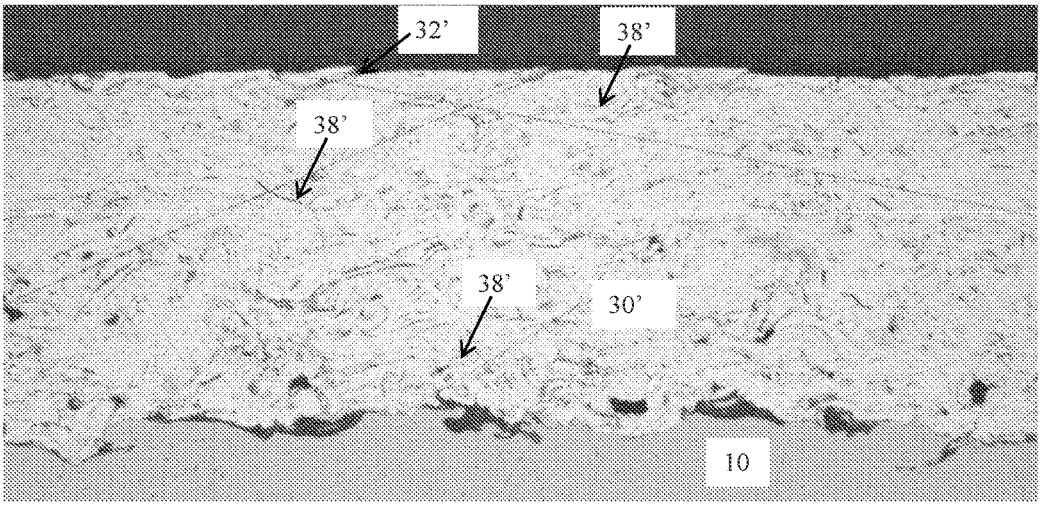
FIG. 3 is an optical photo micrograph of a coated article after undergoing vibratory finishing.

FIG. 3 illustrates the microstructure of the coated article 10 after the above vibratory finishing process. Again, the article or substrate is generally indicated as 10, while the coating, having the finished characteristics (as opposed to as-sprayed characteristics), is indicated as 30'. In contrast to the microstructure seen in FIG. 2, the surface of the finished coating 30' has greatly reduced surface porosity (e.g., at least a 2× reduction in surface porosity). As illustrated in FIG. 3, there are nearly no surface pores remaining. This is due to the peening effect caused by the repeated impact of the vibratory media 50 on the surface of the coating. The repeated impact of the media 50 closes the surface porosity such that debris, contaminants, and bacteria cannot easily penetrate into the coating 30'. This reduces the likelihood that the finished coating 30' will stain or otherwise discolor due to repeated handling or user contact over its lifetime, and thereby eliminates the need for application of a sealant. Sub-surface pores are also greatly reduced in the upper portion of the coating 30', improving the density of the coating 30'.

In addition to reducing surface and sub-surface porosity, the vibratory finishing process also reduces the surface roughness of the as-sprayed coating 30. As seen in FIG. 3, the finished coating 30' has greatly reduced or smoothed peaks and valleys as compared to the as-sprayed coating 30, again contributing to the stain-resistance of the article. This smoothing effect caused by the vibratory finishing is counter to the usual use of vibratory finishing, which is intended to add texture or roughness to originally smooth surfaces. However, the peening effect still provides a desirable and aesthetically-pleasing distressed metal look to the finished coating 30'.

Yet another outcome achieved via the vibratory finishing process is the refinement of the finished microstructure by the thinning and percent-volume reduction of the oxide stringers present in the upper portion (e.g., the upper one-third) of the microstructure. As the droplets of molten feedstock material impinge the substrate, they flatten and solidify into "splats. In the case of metallic coating materials sprayed in open air, a thin oxide film often forms around the molten droplets. Upon impact and solidification these oxide films, or shells, form "stringers" around the spreading splat. These oxide stringers can be seen in typical optical photomicrographs of the microstructures of metallic coatings. The oxide stringers are indicated as 38' in FIG. 3, and are reduced in percent-volume in the upper one-third of the coating 30'. In one image analysis, the oxide stringers 38' in the upper one-third of the coating 30' were found to be 5% by volume, while the oxide stringers 38' in the lower two-thirds of the coating 30' were found to be 6.7% by volume. The oxide stringers 38' are also noticeably thinned and elongated in the upper one-third of the coating 30' (e.g., about 0.00005 in. thick) as compared to the oxide stringers 38' in the lower two-thirds of the coating 30' (e.g., about 0.0001 in. thick). This provides a refined and improved microstructure to the finished coating 30'.

The article 20 was placed in a one cubic foot bowl along with 0.4375 inch×1.0 inch ACC vibratory media 60 (see FIG. 1). The vibratory media 60 was a twenty degree, medium cut media 60 available from Midwest Finishing Systems, Inc. under the compound number MFS-232L. Other media can be substituted as desired. The article 20 and the media 60 were moved/vibrated in the bowl for approximately 3 hours to achieve similar finished coating characteristics as discussed above with respect to the article 10. Those of skill in the art will again understand that the specific bowl size, media, and duration of finishing can be varied as desired to achieve the desired finished characteristics.

The mechanical action of the vibratory polishing has refined the microstructure of the subject coatings as indicated by the reduced thickness of the splats, the shortened length of the oxide stringers, and the reduction in apparent porosity.

Various features and advantages of the invention are set forth in the following claims.

What is claimed is:

1. A method of coating and finishing an article, the method comprising:

applying a coating to the article using a spray-coating technique such that the applied coating has an as-sprayed surface porosity; and reducing the as-sprayed surface porosity of the coating to a finished surface porosity using a vibratory finishing process;

wherein the vibratory finishing process reduces the as-sprayed surface porosity by closing surface porosity in the as-sprayed coating; and wherein no sealant is applied after applying the coating.

2. The method of claim 1, further comprising reducing an as-sprayed surface roughness of the coating to a finished surface roughness during the vibratory finishing process.

3. The method of claim 2, wherein the vibratory finishing process reduces the as-sprayed surface roughness of the coating by smoothing peaks and valleys in the as-sprayed coating.

4. The method of claim 1, wherein the vibratory finishing process includes placing the article having the applied coating in a container with vibratory media and causing the vibratory media within the container to repeatedly impact the coated article.

5. The method of claim 1, wherein the coating includes copper.

6. The method of claim 5, wherein the coating includes brass.

7. The method of claim 5, wherein the spray-coating technique is a thermal-spray coating technique.

8. The method of claim 5, wherein the spray-coating technique is a cold-spray coating technique.

9. The method of claim 1, further comprising cleaning and grit-blasting the article prior to applying the coating.

10. The method of claim 1, wherein the vibratory finishing process reduces surface porosity by at least 2 times as compared to the as-sprayed surface porosity.

11. The method of claim 1, further comprising reducing a percent-volume of oxide stringers in an upper portion of the applied coating as compared to the lower portion of the applied coating during the vibratory finishing process.

12. The method of claim 11, further comprising reducing a thickness of the oxide stringers in an upper portion of the applied coating as compared to the lower portion of the applied coating during the vibratory finishing process.

13. The method of claim 1, wherein the spray-coating technique is a thermal-spray coating technique.

14. The method of claim 13, wherein the thermal spray coating technique is an electric arc spray technique.

15. The method of claim 1, wherein no fusing of the coating takes place after applying the coating.

16. A method of coating and finishing an article, the method comprising:

cleaning a surface of the article;

applying a coating to the article using a thermal spray-coating technique such that the applied coating has an as-sprayed surface porosity, an as-sprayed surface roughness, and an as-sprayed microstructure; and reducing the as-sprayed surface porosity, reducing the as-sprayed surface roughness, and refining the as-sprayed microstructure of the coating to a finished surface porosity, a finished surface roughness, and a finished microstructure, respectively, using a vibratory finishing process, the vibratory finishing process including placing the article having the applied coating in a container with vibratory media and causing the vibratory media within the container to repeatedly impact the coated article;

wherein the vibratory finishing process reduces the as-sprayed surface porosity by closing surface porosity in the as-sprayed coating; and wherein no sealant is applied after applying the coating.

17. The method of claim 16, wherein the coating includes copper.

18. The method of claim 17, wherein the coating includes brass.

19. The method of claim 16, wherein the vibratory finishing process reduces surface porosity by at least 2 times as compared to the as-sprayed surface porosity, wherein the vibratory finishing process reduces a percent-volume of oxide stringers in an upper portion of the applied coating as compared to the lower portion of the applied coating, and wherein the vibratory finishing process reduces a thickness of the oxide stringers in an upper portion of the applied coating as compared to the lower portion of the applied coating.

20. The method of claim 16, wherein no fusing of the coating takes place after applying the coating.

* * * * *